US008627878B2

(12) United States Patent
Cox et al.

(10) Patent No.: US 8,627,878 B2
(45) Date of Patent: Jan. 14, 2014

(54) SYSTEM AND METHOD FOR NON-CONTACT SENSING TO MINIMIZE LEAKAGE BETWEEN PROCESS STREAMS IN AN AIR PREHEATER

(75) Inventors: William C. Cox, Wellsville, NY (US); Kevin J. O'Boyle, Alma, NY (US); John D. Proctor, Wellsville, NY (US)

(73) Assignee: ALSTOM Technology Ltd, Baden (CH)

( * ) Notice: Subject to any disclaimer, the term of this patent is extended or adjusted under 35 U.S.C. 154(b) by 916 days.

(21) Appl. No.: 12/557,751

(22) Filed: Sep. 11, 2009

(65) Prior Publication Data

US 2011/0061831 A1 Mar. 17, 2011

(51) Int. Cl.
*F23L 15/02* (2006.01)
*F28D 17/00* (2006.01)

(52) U.S. Cl.
USPC ..... 165/9; 165/4; 165/8

(58) Field of Classification Search
USPC ..... 165/4, 8, 9
See application file for complete search history.

(56) References Cited

U.S. PATENT DOCUMENTS

| | | | | |
|---|---|---|---|---|
| 2,681,208 | A | 6/1954 | Boestad et al. | |
| 3,232,335 | A | 2/1966 | Kalbfleisch | |
| 3,246,686 | A | 4/1966 | Kalbfleisch et al. | |
| 2005/0236150 | A1* | 10/2005 | Chagnot et al. | 165/222 |

FOREIGN PATENT DOCUMENTS

| | | |
|---|---|---|
| JP | 06-241677 | 9/1994 |
| JP | 9 042873 | 2/1997 |
| WO | WO 98/06993 | 2/1998 |

OTHER PUBLICATIONS

International Search Report and the Written Opinion of the International Searching Authority dated Apr. 5, 2011 (PCT/US2010/044260).

Notice of Preliminary Rejection from the Korean Patent Office dated Oct. 15, 2013 for Korean application 10-2012-7009112.

* cited by examiner

*Primary Examiner* — Ljiljana Ciric
*Assistant Examiner* — Travis Ruby

(57) ABSTRACT

A rotary air preheater 10 includes a housing 12 having a rotor 14. The rotor 14 has opposing ends 20,24 and is divided into sections by diaphragms 48. Sector plates 28 include one sector plate 28 in sealing relation with one of opposing ends 20,24 of the rotor 14. The air preheater 10 includes a flange 56 and a sensing device 49 coupled to at least one of the sector plates 28. The sensing device 49 provides non-contact sensing of a distance between the sector plate 28 and the flange 56. The sensing device 49 includes a conduit 54 that directs a jet of compressed air onto the flange 56, a first pressure sensor 60 and a second pressure sensor 70. The first pressure sensor 60 senses pressure inside the sensing device 49, and the second pressure sensor 70 senses pressure outside the sensing device 49. The distance between the sector plate and the flange is a pressure difference measured by the first and the second pressure sensors 60,70. In one embodiment, the first pressure sensor 60 senses a backpressure within the sensing device 49.

10 Claims, 4 Drawing Sheets

FIGURE 4A

SYSTEM AND METHOD FOR NON-CONTACT SENSING TO MINIMIZE LEAKAGE BETWEEN PROCESS STREAMS IN AN AIR PREHEATER

TECHNICAL FIELD

The disclosed subject matter relates to a system and method for minimizing process air leakage within an air preheater. More specifically, the disclosed subject matter relates to a system and method for minimizing process air leakage in an air preheater by utilizing a non-contact, rotor position sensor.

BACKGROUND

An air preheater, often referred to as a rotary air preheater, transfers heat from a hot gas stream such as, for example, flue gas leaving a boiler, to one or more colder gas streams such as, for example, a combustion air stream entering the boiler. Heat is transferred from the hot gas stream to the colder gas stream (s) through a regenerative heat transfer surface in a rotor of the air preheater, which turns continuously through both the hot and colder gas streams. Hereinafter, the hot gas stream shall be referred to as the flue gas stream while the colder gas stream(s) shall be referred to as the combustion air stream(s) or air stream(s).

The rotor, which is packed with the regenerative heat transfer surface, is divided into compartments by a number of radially extending plates referred to as partition walls or diaphragms. The compartments hold baskets in which the regenerative heat transfer surface is contained.

The air preheater rotor is further divided into a flue gas passage and one or more air passages by sector plates. From a temperature standpoint, the air preheater may also be considered as being divided into descriptive regions commonly referred to as hot and cold ends. For a conventional rotary air preheater, the hot end region describes all stationary and rotating components in general proximity to the axial end where the hot flue gas enters the air preheater. The cold end refers to the general region at the axial end opposite the hot end, where the cold combustion air enters the air preheater. In a typical installed rotary air preheater, rigid or flexible radial seals are mounted at the hot and cold end edges of the rotor diaphragms and in close proximity to their respective hot and cold end sector plates. The radial seals help to minimize the leakage of air to the flue gas stream, as well leakage between multiple air streams. Similarly, rigid or flexible axial seals mounted on outboard edges of the diaphragms are in close proximity to axial seal plates mounted on an inner surface of the housing and minimize leakage therebetween. The axial seals and axial seal plates are located in the general region between the hot and cold ends of the air preheater.

In typical installed air preheaters, the number of diaphragms and the width of the sector plates and the seal plates are such that only one radial seal and one axial seal are disposed proximate to the respective plate at any one time. These seals are proximity seals and are not designed to contact the sealing surface of the sector plates or axial seal plates. They are, in fact, typically installed with predetermined clearance gaps to their respective sealing plates. In the case of the cold end radial seals and the axial seals, the clearance gaps are used to avoid relatively substantial seal contact and wear that would result from the operating thermal deformations of the rotor diaphragms. At both the cold end radial seals and the axial seals, operating thermal deformations tend to move the seals closer to their respective sealing plates. Thus, predetermined seal clearance gaps at the time of installation are typically reduced during operation, and the leakage at these seals is passively minimized. In the case of the hot end radial seals, thermal deformations tend to move the outboard ends of these seals away from the hot end sector plates. Consequently, thermal deformations can cause an increase in the leakage past the hot end radial seals, where the amount of leakage is dependent on the pressure differential between the air and gas streams as well as the thermally enlarged gaps between the seals and the sector plates.

To minimize hot end radial seal leakage, it is often advantageous to make use of automatically actuated hot end sector plates that enable the aforementioned outboard leakage gaps to be reduced during operation. Such adjustments are achieved utilizing a mechanical drive system located near the outboard end of the hot end sector plates. In order to achieve proper on-line adjustment, sector plates are often fitted with rotor position sensing devices. Typically, sensing devices contain mechanical limit switches and a sensor rod and, working in conjunction with the sector plate drive system, rely on momentary contact with a sensing surface on the rotor to determine rotor position. Given a fixed dimensional relationship between the rotor sensing surface and the edges of the hot end radial seals, the detection of this sensing surface enables the sector plate drive system to position the sector plate closely to the edges of the hot end radial seals. In this way, hot end radial seal leakage can be minimized.

Over the long term, repeated contact with the rotor sensing surface eventually leads to failure of the limit switches or wear of the sensor rod. Failure of the limit switches and wear of the sensor rod may result in the need for frequent maintenance.

SUMMARY

According to aspects illustrated herein, there is provided a rotary air preheater including a stationary housing having a rotatable rotor. The rotor has opposing ends which are in communication with at least one air duct for flowing combustion air therethrough and at least one flue gas duct for flowing flue gas therethrough. The rotor is divided into a plurality of sections by radially extending diaphragms. The air preheater includes a plurality of sector plates. One sector plate is in sealing relation with respect to one of the opposing ends of the rotor. A flange is fixedly attached to the rotor and extends circumferentially around at least one of the opposing ends of the rotor. The air preheater includes a sensing device coupled to at least one of the sector plates. The sensing device is for sensing a distance between the at least one sector plate and the flange. The sensing device includes a compressed air conduit for directing a jet of compressed air onto the flange. The compressed air conduit has a first pressure tap positioned in proximity to a point at which the jet is output onto the flange. The first pressure tap is configured to determine backpressure at a point inside in the compressed air conduit. The sensing device includes a first sensor in communication with said first pressure tap. The first sensor is configured for sensing the backpressure. The first sensor is an electrical sensor. The sensing device includes a second pressure tap in communication with at least one of the at least one air duct and the at least one flue gas duct. The said second pressure tap is in communication with the first sensor. The first sensor generates outputs for determining the distance between the at least one sector plate and the flange based upon a difference in pressure measurements taken at said first pressure tap-and said second pressure tap.

In one embodiment, the air preheater includes a second sensor and a third pressure tap located upstream of the first pressure tap in an air supply line. The third pressure tap is in communication with a compressed air supply and the second sensor. A controller is in communication with the second sensor. A temperature sensor disposed in proximity to the third pressure tap and remotely from the sensing device. An output of the third pressure tap is provided to the second sensor and an output of the temperature sensor and the second sensor are provided to the controller for calculating a compressed air flow rate in the air supply line.

In one embodiment, the sensing device further includes a nozzle coupled to the compressed air conduit. In one embodiment, the first sensor is comprised of a differential pressure transducer, and the second sensor is comprised of an absolute pressure transducer.

According to aspects illustrated herein, there is provided a method for determining a distance between a sector plate and a flange in a rotary air preheater. The method includes providing a stationary housing having a rotatable rotor disposed therein, the rotor having opposing ends, said opposing ends being in communication with at least one air duct and at least one flue gas duct, and the flange being fixedly attached to the rotor and extending circumferentially around at least one opposing end of the rotor. The method also includes providing a sensing device coupled to the rotary air preheater. The sensing device includes a compressed air conduit. The compressed air conduit has a first pressure tap positioned in proximity to the flange. The sensing device includes a first sensor in communication with the first pressure tap. The first sensor is an electrical sensor. The sensing device includes a second pressure tap that is in communication with the first sensor and at least one of the at least one air duct and the at least one flue gas duct. The second pressure tap is in communication with the first sensor. Combustion air flows through the at least one air duct and flue gas flows through the at least one flue gas duct. A jet of compressed air is directed through the sensing device and onto the flange. A backpressure is determined at the first pressure tap using the first sensor. A second pressure is measured at a point in at least one of the at least one air duct and the at least one flue gas duct using the first sensor. Outputs are generated from the first sensor. A distance between the sector plate and the flange is determined using the outputs by measuring a difference in pressure measurements taken at the first pressure tap and the second pressure tap such that as the backpressure decreases, the distance increases and as the backpressure increases, the distance decreases.

In one aspect, a method for determining a distance between two points in a rotary air preheater is provided. The method includes directing a jet of compressed air onto a flange fixedly attached to a rotor. The flange extends circumferentially around at least one opposing end of the rotor. The method also includes measuring a first pressure at a point inside a sensing device, measuring a second pressure at a point outside the sensing device, and determining a distance between the flange and at least one of a plurality of sector plates of the rotary air preheater. The distance between the sector plate and the flange is determined by a difference in the first pressure measurement and the second pressure measurement.

It should be appreciated that the above described and other features are exemplified by the following figures and detailed description.

BRIEF DESCRIPTION OF THE DRAWINGS

Referring now to the figures, which are exemplary embodiments, and wherein the like elements are numbered alike.

DETAILED DESCRIPTION OF PREFERRED EMBODIMENTS

Figure 1:
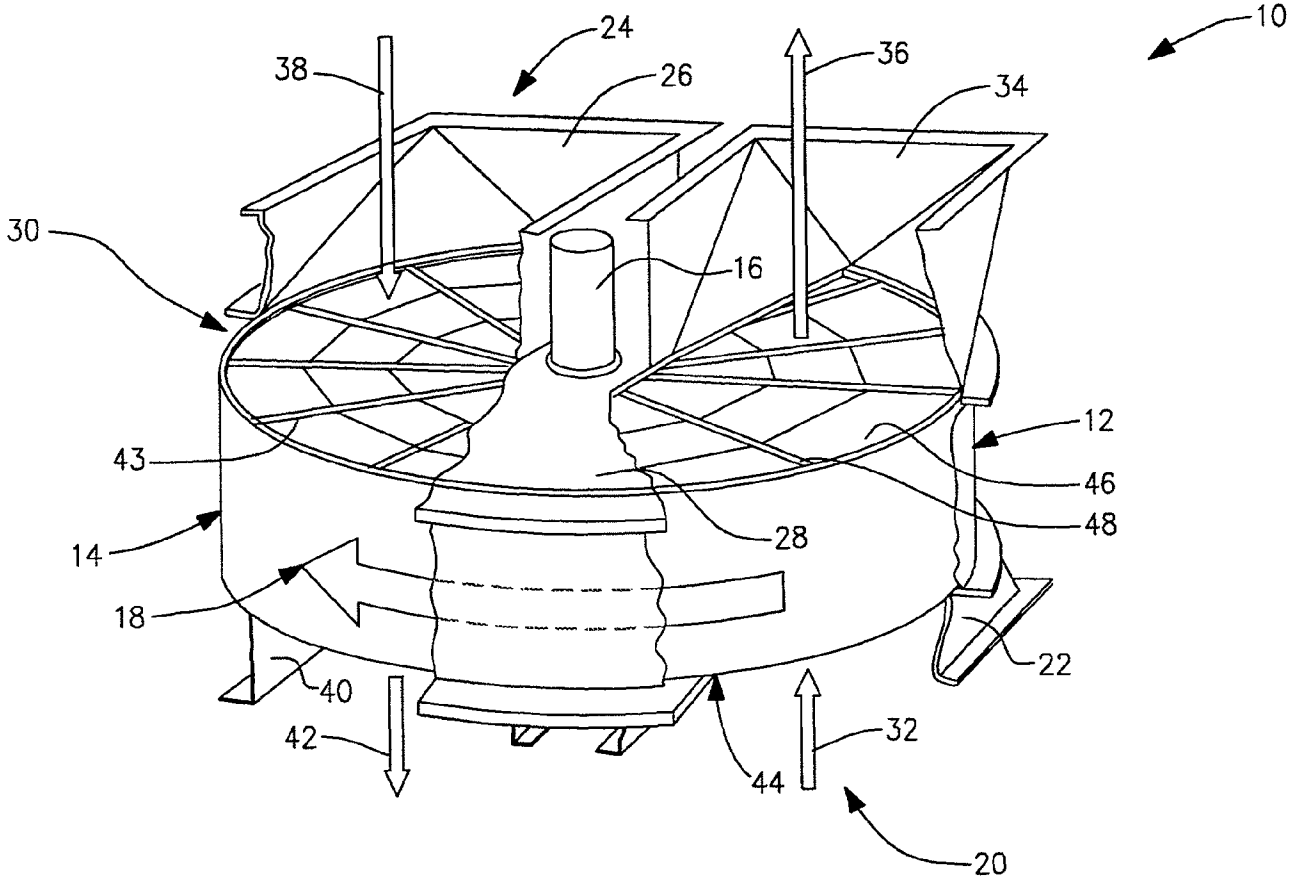
FIG. 1 is a partially cut-away perspective view of an air preheater that is modified according to one particular embodiment.

FIG. 1 illustrates an air preheater 10 utilized for preheating a cold gas stream such as combustion air, by transferring heat from a hot gas stream such as a flue gas stream. The air preheater 10 includes a stationary housing 12 in which a rotor 14 is mounted. Rotor 14 includes a heat-regenerable mass (not shown) that enables the transfer of heat from the flue gas to the combustion air. Rotor 14 is typically rotated in a continuous manner about a center axis, for example, a center post 16. In one embodiment, the rotation of rotor 14 is about one revolution per minute (1 r.p.m.). Rotation of the rotor 14 enables the transfer of heat from the flue gas to the combustion air. Rotation of rotor 14 is indicated by an arrow 18. While arrow 18 points in a clockwise direction in FIG. 1, it is contemplated that rotor 14 may rotate in a counterclockwise direction.

From a temperature standpoint, the air preheater 10 may be considered as being divided into descriptive regions commonly referred to as a hot end 24 and a cold 20 end. As described herein, the hot end 24 region describes all stationary and rotating components in general proximity to an axial end of the air preheater 10 where the hot flue gas enters (as indicated by arrow 38) a gas inlet duct 26 and the preheated air exits (as indicated by arrow 36) an air outlet duct 34. The cold end 20 region describes all stationary and rotating components in general proximity to an axial end of the air preheater 10 opposite the hot end 24, where the cold combustion air enters (as indicated by arrow 32) the air preheater 10 at an air inlet duct 22 and the cooled flue gas exits (as indicated by arrow 42) a flue gas outlet duct 40. At the proximate elevations of the hot end 24 and the cold end 20 axial faces of the rotor 14, the stationary housing 12 is divided by means of stationary, flow restricting, sector plates 28. As shown in FIG. 1, a sector plate 28 is located at a hot end surface 30 of the rotor 14. The surface 30 represents a plane containing sealing edges of all of hot end radial seals 43. In a similar way, the cold end surface 44 represents the plane containing sealing edges of all of cold end radial seals (not shown). Accordingly, hot gases, for example, flue gases from a boiler, enter the air preheater 10 through the gas duct 26 (arrow 38), flow through the rotor 14 where heat is transferred from the gas to heat regenerable mass in the rotor 14, and the cooled gas then exits through the gas outlet duct 40 (arrow 42). A countercurrent flowing colder gas stream, such as, for example, a combustion air, enters through the inlet duct 22 (arrow 32), flows through the rotor 14, where the air stream picks up heat from the rotor 14 and becomes heated. The heated air exits through the outlet duct 34 (arrow 36).

The hot end sector plate 28 is mounted close to the hot end surface 30 of the rotor 14. Another sector plate (not shown) is mounted close to a similar cold end surface 44 of the rotor 14. While the opposing ends of the rotor 14, e.g., the hot end surface 30 and the cold end surface 44, allow the inflow and outflow of the flue gas and the combustion air, the sector plates 28 make use of the rotor diaphragms 48, the hot end radial seals 43 and the cold end radial seals to create separate passages within the rotor for the flue gas and combustion air. The sector plates 28 successfully reduce leakage of combustion air to the flue gas stream provided the clearance between the sector plates 28 and the hot end and cold end surfaces 30 and 44 can be kept low.

Figures 2, 3:
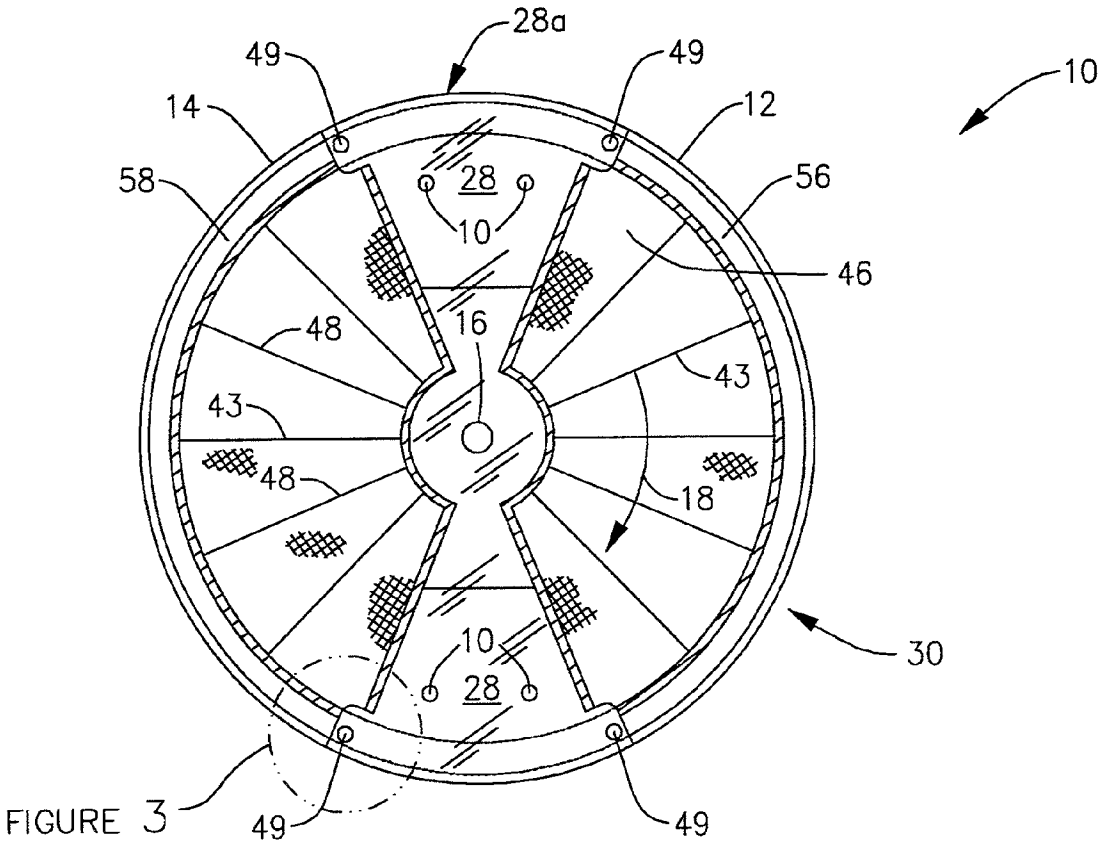
FIG. 2 is a schematic plan view of one embodiment of the air preheater of FIG. 1 illustrating non-contact position sensors.
FIG. 3 is a partial detail elevational view of the portion of FIG. 2 labeled "Detail 3" illustrating one embodiment of the non-contact position sensor.
Figure 3:
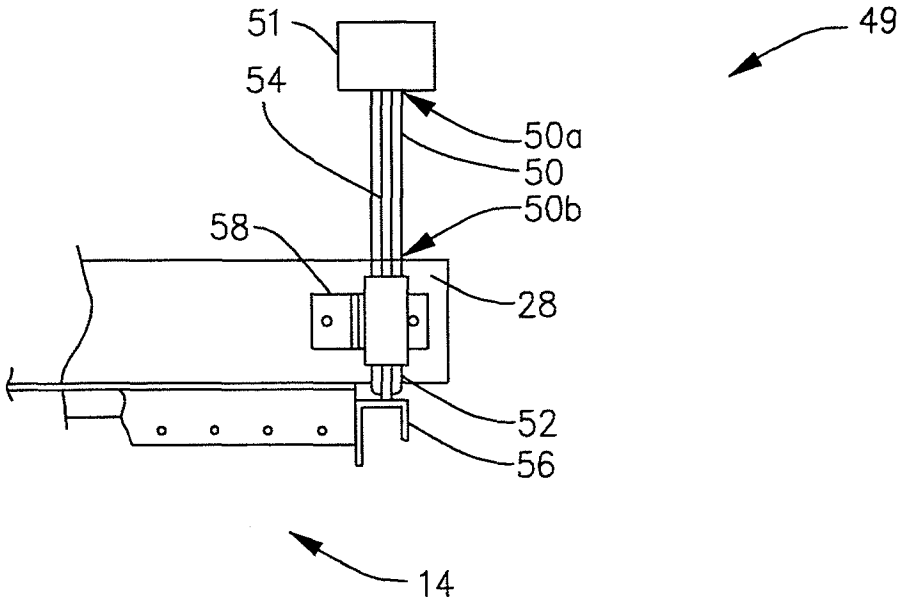

As shown in FIGS. 1 and 2, the rotor 14 is divided into sections or sectors 46 by radially extending diaphragms 48 and radial seals 43, edges of which are marked in FIG. 2. The outer ends of the sector plate are guided by a sensing device 49. In one embodiment, as shown in FIG. 2, the outer ends of the sector plate 28 are guided by a plurality of sensing devices 49 (e.g., two sensing devices shown). As shown in FIG. 2, the sensing device 49 is located on an outboard end, shown generally at 28*a*, of the hot end sector plate 28. In one embodiment, a sector plate drive system as described herein moves the entire outboard end 28*a* of the sector plate 28 while maintaining the sector plate 28 in substantially a level plane. While FIG. 2 illustrates two (2) sensing devices 49, it is contemplated that any number of sensing devices may be utilized, including, but not limited to a single sensing device. The number of sensing devices may vary based on the application in which the air preheater 10 is installed. It should also be appreciated that while shown on the outboard end 28*a* of the sector plate 28, the sensing device 49 may be located on the inboard end of the sector plate 28.

As shown in FIG. 3, in one embodiment, the sensing device 49 includes a sleeve or tube 50 having opposing ends, e.g., a first end 50*a* and a second end 50*b*. In one example, the sensing device 49 includes an air source 51 coupled to the first end 50*a* of the sensing device 49. The air source 51 may be any device capable of producing a stream of high-pressure air. Examples of air source 51 include, but are not limited to air compressors and the like. In one embodiment, the air source 51 exists on-site at the facility where the air preheater 10 is installed. As such, a conduit such as a pipe, hose or the like, couples the air source 51 to the sensing device 49. In one embodiment, a flow rate of the compressed air is controlled by passing it through a small, fixed diameter orifice (control orifice 80 described below) at sonic velocity. In this way, the flow rate is controlled since the velocity of the air leaving the fixed orifice cannot exceed the speed of sound in air (e.g., choked flow). The minimum orifice air pressure ratio required to achieve this condition is approximately:

$$P_{beforeorifice}/P_{afterorifice}=1.90.$$

Ratios above 1.90 do not result in orifice velocities exceeding the speed of sound. Accordingly, compressed air is supplied to the orifice air at a pressure that allows this ratio to be exceeded by an appropriate margin of safety, as can be appreciated by those skilled in the art.

As shown in FIG. 3, the sleeve 50 of the sensing device 49 includes a compressed air conduit 54. The compressed air conduit 54 extends inside the sleeve 50 from the first end 50*a* to the second end 50*b*, and through a nozzle 52 coupled to the second end 50*b*. The compressed air conduit 54 directs a jet, or stream, of air from the air source 51 at the first end 50*a* of the sensing device 49 to the second end 50*b* of the sensing device 49. As shown in FIG. 3, the jet of air is directed through the nozzle 52 onto a flange 56. In one embodiment, the jet of air is directed through the compressed air conduit 54 at a constant, continuous rate. In another embodiment, the jet of air may be intermittent. In one embodiment, the airflow rate through the conduit while sensing is about approximately fifty Standard Cubic Feet of air per Minute (50 scfm). In one embodiment, a continuous supply of air at 50 scfm is provided. In another embodiment, an intermittent or continuous purging of pressure taps is provided such that the nozzle 52 and the compressed air conduit 54 remain free from clogging by contaminants such as, for example, fly ash.

As shown in FIGS. 2 and 3, the sensing device 49 interacts with the flange 56 to provide non-contact position sensing as described herein. The flange 56 extends circumferentially around the rotor 14, at the top and bottom thereof, e.g., along the hot end surface 30 and the cold end surface 44, respectively. The relationship between the flange 56, the sector plate 28, the rotor 14 and the sensing device 49 is shown in more detail in FIGS. 3 and 4.

Figures 4, 4A:
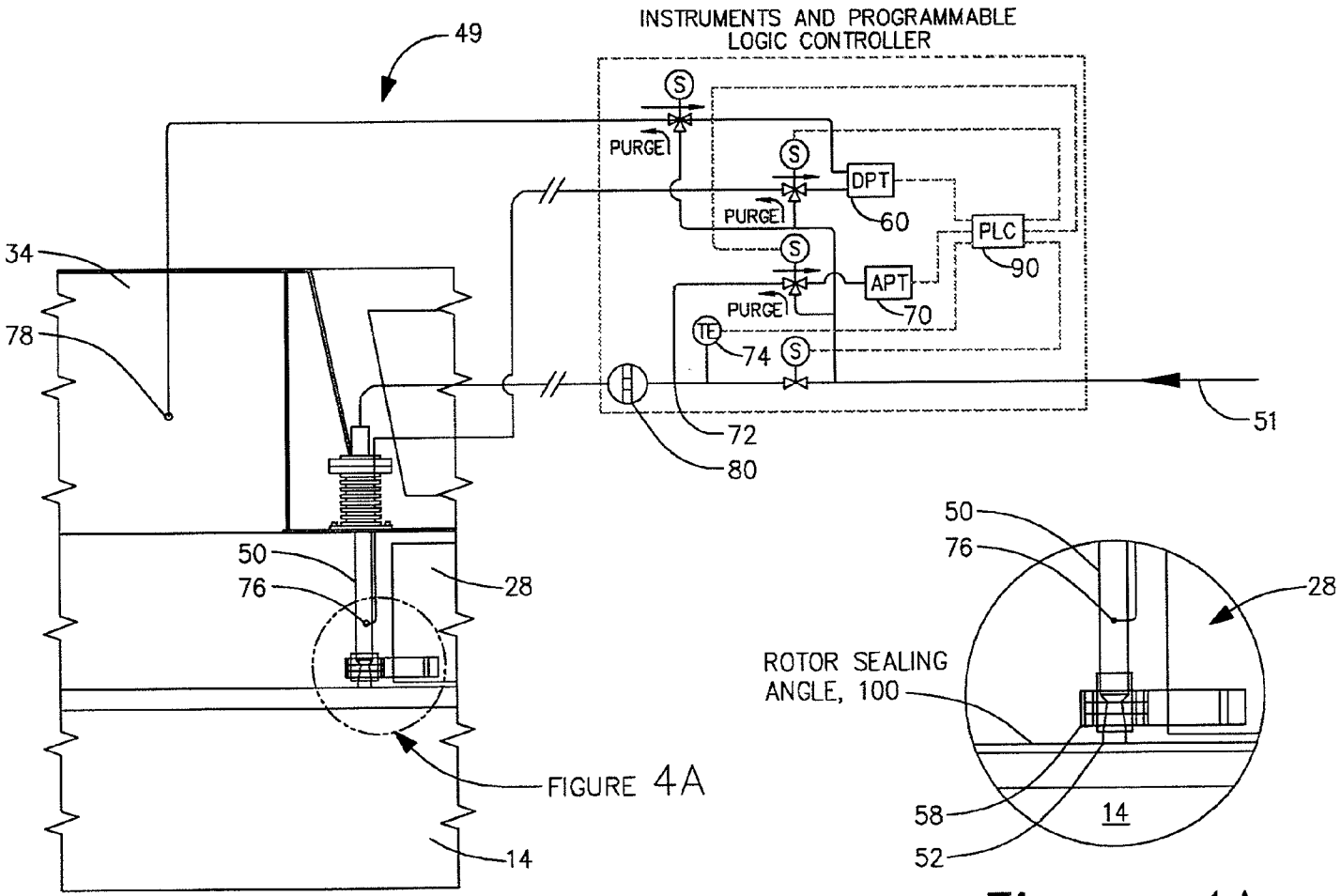
FIG. 4 is partial detailed view of the non-contact sensor of FIG. 2.
FIG. 4A is an enlarged view of a portion of FIG. 4.

As shown in FIGS. 3 and 4A, the sensing device 49 is fixedly mounted to the sector plate 28 by, for example, a sensor mounting bracket 58. The sensing device 49 is not in contact with the flange 56 or any portion of the sector 46 or the diaphragm 48. It is seen that reduction or elimination of contact between the sensing device 49 and the flange 56 decreases or substantially eliminates wear and tear experienced in this portion of the air preheater 10 and, as such, decreases the amount of maintenance required by the air preheater 10. In one embodiment, the sensing device 49 includes a first sensor 60 and a second sensor 70. Examples of sensors include, but are not limited to pressure transducers and the like, such as for example, a differential pressure transducer (DPT) and an absolute pressure transducer (APT). As shown in FIG. 4, the first sensor 60 and the second sensor 70 may be located remotely from the sleeve 50 and nozzle 52 of the sensing device 49 to protect the sensors, and supporting hardware described below, from harsh operating conditions such as, for example, high temperatures and/or contaminants such as fly ash.

As shown in FIG. 4, the first sensor 60 and the second sensor 70 receive static pressure signals from a plurality of pressure taps (e.g., a first pressure tap 76, a second pressure tap 78 and/or a third pressure tap 72). The third pressure tap 72 is disposed in the conduit carrying compressed air from the compressed air source 51. The third pressure tap 72 is located upstream of a flow controlling orifice 80. As noted above, the flow controlling orifice 80 controls a flow rate of the compressed air as it passes from the compressed air source 51 to the sensing device 49 (e.g., maintaining the above described minimum orifice air pressure ratio). Output of the third pressure tap 72 is provided to the second sensor 70. A temperature sensor (TE) 74 is disposed in proximity to the first pressure tap 72. Output signals from the second sensor 70 and the temperature sensor 74 are provided to a controller 90 such as, for example, a programmable logic controller (PLC). The PLC 90 calculates a compressed air flow rate from the output of the second sensor 70 and the temperature sensor 74. The first pressure tap 76 is located on the sensor sleeve 50 near the nozzle 52 at end 50b to measure pressure within the compressed air conduit 54. The second pressure tap 78 is located on an exterior wall of a duct such as, for example, the air outlet duct (34 of FIG. 1), to measure the internal duct pressure on the same side (e.g., hot or cold side) as the sensing device 49. In one embodiment , the second pressure tap 78 is in communication with a flue gas duct of the rotor. Output signals from the first pressure tap 76 and the second pressure tap 78 are provided to the first sensor 60. The first sensor 60 senses a difference in pressure between the compressed air within the air conduit 54 of the sensor sleeve 50 and the pressure within the air outlet duct (34 of FIG. 1). The output of the first sensor is provided to the PLC 90. The PLC 90 determines a position of the rotor 14 based upon the difference in pressure between the compressed air within the compressed air conduit 54 of the sensor sleeve 50 and the pressure within the air outlet duct 34.

It should be appreciated that a portion of the air stream directed onto the flange 56 from the compressed air conduit 54 and the nozzle 52 is deflected back into the compressed air conduit 54 after it strikes a portion of the flange 56 (often referred to as "backpressure"). As the distance between the sector plate 28 and the flange 56 changes (e.g., increases or decreases), the amount of air deflected back from the flange 56 into the compressed air conduit 54 varies. For example, as the distance between the flange 56 and the sector plate 28 increases, the backpressure measured by the first pressure tap 76 decreases. Similarly, as the distance between the flange 56 and the sector plate 28 decreases, the backpressure measured by the first pressure tap 76 increases. Accordingly, the distance between the sector plate 28 and the flange 56 is related to a difference in pressure measurements of the compressed air conduit 54 of the sensing sleeve 50 and the pressure within the duct 34. As described herein, the pressure measurements are utilized as a non-contact sensor for determining the position of the sector plate 28 in relation to the flange 56.

For example, in one embodiment, the PLC 90 interprets the pressure difference to determine positional information and provides appropriate commands to a sector plate drive system (not shown) in order to adjust the leakage gaps and/or rotor sealing angle 100 to minimize radial seal leakage.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A rotary air preheater, comprising:

a stationary housing having a rotatable rotor disposed therein, said rotor having opposing ends, the opposing ends being in communication with at least one air duct for flowing combustion air therethrough and at least one flue gas duct for flowing flue gas therethrough, wherein said rotor is divided into a plurality of sections by radially extending diaphragms;

a plurality of sector plates, wherein one sector plate is in sealing relation with respect to one of said opposing ends of said rotor;

a flange fixedly attached to said rotor and extending circumferentially around at least one of said opposing ends of said rotor; and a sensing device coupled to at least one of said sector plates, said sensing device for sensing a distance between said at least one sector plate and said flange, wherein said sensing device comprises:

a compressed air conduit for directing a jet of compressed air onto said flange, said compressed air conduit having a first pressure tap positioned in proximity to a point at which said jet is output onto the flange, the first pressure tap being configured to determine backpressure at a point inside in the compressed air conduit;

a first sensor in communication with said first pressure tap, the first sensor being configured for sensing the backpressure, the first sensor being an electrical sensor;

a second pressure tap in communication with at least one of said at least one air duct and said at least one flue gas duct, said second pressure tap being in communication with said first sensor; and wherein said first sensor generates outputs for determining said distance between said at least one sector plate and said flange based upon a difference in pressure measurements taken at said first pressure tap and said second pressure tap.

2. The rotary air preheater according to claim 1, wherein said first sensor is disposed remotely from said sensing device.

3. The rotary air preheater according to claim 1, further including:

a second sensor;

a third pressure tap located upstream of the first pressure tap in an air supply line, the third pressure tap being in communication with a compressed air supply and said second sensor;

a controller in communication with said second sensor;

a temperature sensor disposed in proximity to said third pressure tap and remotely from said sensing device, wherein output of said third pressure tap is provided to said second sensor; and wherein output of said temperature sensor and said second sensor are provided to said controller for calculating a compressed air flow rate in the air supply line.

4. The rotary air preheater according to claim 3, wherein said second sensor is comprised of an absolute pressure transducer.

5. The rotary air preheater according to claim 1, further comprising:

a controller in communication with said first sensor; and wherein an output of said first sensor is provided to said controller for calculating said distance between said at least one sector plate and said flange.

6. The rotary air preheater according to claim 1, wherein said sensing device further comprises a nozzle coupled to said compressed air conduit.

7. The rotary air preheater according to claim 1, wherein said first sensor is comprised of a differential pressure transducer.

8. A method for determining a distance between a sector plate and a flange in a rotary air preheater, said method comprising:

providing a stationary housing having a rotatable rotor disposed therein, said rotor having opposing ends, said opposing ends being in communication with at least one air duct and at least one flue gas duct, and said flange being fixedly attached to said rotor and extending circumferentially around at least one opposing end of said rotor;

providing a sensing device coupled to said rotary air preheater, said sensing device comprising a compressed air conduit, said compressed air conduit having a first pressure tap positioned in proximity to said flange, said sensing device comprising a first sensor in communication with said first pressure tap, said first sensor being an electrical sensor; said sensing device comprising a second pressure tap being in communication with said first sensor and at least one of said at least one air duct and said at least one flue gas duct, said second pressure tap being in communication with said first sensor;

flowing combustion air through said at least one air duct;

flowing flue gas through said at least one flue gas duct;

directing a jet of compressed air through said sensing device and onto said flange;

determining a backpressure at said first pressure tap using said first sensor;

measuring a second pressure at a point in at least one of said at least one air duct and said at least one flue gas duct using said first sensor;

generating outputs from said first sensor; and determining a distance between said sector plate and said flange using said outputs by measuring a difference in pressure measurements taken at said first pressure tap and said second pressure tap such that as said backpressure decreases said distance increases and as said backpressure increases said distance decreases.

9. The method according to claim 8, wherein the jet of compressed air is directed onto the flange at a constant rate.

10. The method according to claim 8, wherein the jet of compressed air is directed onto the flange at an intermittent rate.

* * * * *